US011754378B1

(12) United States Patent
Thoren et al.

(10) Patent No.: US 11,754,378 B1
(45) Date of Patent: Sep. 12, 2023

(54) DEPLOYABLE FLAP FOR HIGH-G MANEUVERS

(71) Applicant: THE CHARLES STARK DRAPER LABORATORY, INC., Cambridge, MA (US)

(72) Inventors: Glenn Richard Thoren, Chelmsford, MA (US); William Whitcomb McFarland, Waltham, MA (US); Rebecca Ann DeFronzo, Salem, MA (US); Stephen Louis Bellio, Newton, MA (US); Jesse M. Carr, Cambridge, MA (US); Jeffery Brandon DeLisio, Arlington, MA (US); Gregory M. Fritz, Acton, MA (US); Sean George, Boston, MA (US)

(73) Assignee: THE CHARLES STARK DRAPER LABORATORY, INC., Cambridge, MA (US)

( * ) Notice: Subject to any disclaimer, the term of this patent is extended or adjusted under 35 U.S.C. 154(b) by 811 days.

(21) Appl. No.: 16/399,453

(22) Filed: Apr. 30, 2019

Related U.S. Application Data

(60) Provisional application No. 62/664,825, filed on Apr. 30, 2018.

(51) Int. Cl.
*F42B 10/14* (2006.01)

(52) U.S. Cl.
CPC ..... *F42B 10/14* (2013.01)

(58) Field of Classification Search
CPC ..... F42B 10/14; F42B 10/20
See application file for complete search history.

(56) References Cited

U.S. PATENT DOCUMENTS

| | | | | | |
|---|---|---|---|---|---|
| 2,941,764 | A * | 6/1960 | Lee, Jr. | B64D 25/12 | 244/3.28 |
| 4,209,146 | A * | 6/1980 | Mattson | F42B 10/14 | 244/3.27 |
| 4,334,657 | A * | 6/1982 | Mattson | F42B 30/10 | 244/3.28 |
| 4,699,333 | A * | 10/1987 | Pinson | F42B 10/64 | 244/3.28 |
| 5,282,588 | A * | 2/1994 | August | F42B 10/64 | 244/3.27 |
| 5,398,887 | A * | 3/1995 | Wassom | F42B 10/14 | 244/3.22 |
| 7,611,095 | B1 * | 11/2009 | Alban, III | F42B 10/62 | 244/158.7 |
| 8,890,043 | B2 * | 11/2014 | Cohe | F42B 10/18 | 244/3.28 |

* cited by examiner

*Primary Examiner* — Nicholas McFall
*Assistant Examiner* — Marisa V Conlon
(74) *Attorney, Agent, or Firm* — Brooks Kushman P.C.

(57) ABSTRACT

A tail for a projectile includes a body having a longitudinal axis. A steering assembly is secured to the body. The steering assembly includes a flap movable from a first position in which the flap does not extend radially beyond the body to a second position in which the flap extends radially beyond the body and at an angle relative to the longitudinal axis, and a flap release mechanism. A projectile including a tail according to the present disclosure is also provided.

25 Claims, 13 Drawing Sheets

DEPLOYABLE FLAP FOR HIGH-G MANEUVERS

CROSS-REFERENCE TO RELATED APPLICATION

This application claims priority under 35 U.S.C. § 119(e) to U.S. Provisional Application Ser. No. 62/664,825 titled "DEPLOYABLE FLAP FOR HIGH-G MANEUVERS" filed Apr. 30, 2018, which is incorporated herein by reference in its entirety for all purposes.

ITAR CONTROLLED TECHNICAL DATA

The contents of this application are subject to the International Traffic in Arms Regulations (ITAR).

SUMMARY

According to an aspect of the present disclosure, a tail for a projectile is provided. In some embodiments, the tail includes a body having a longitudinal axis; a plurality of strakes on the body; and a steering assembly secured to the body. In some embodiments, the steering assembly includes a flap movable from a first position in which the flap does not extend radially beyond the body to a second position in which the flap extends radially beyond the body and at an angle relative to the longitudinal axis; and a flap release mechanism.

In some embodiments, the flap extends a predetermined distance in a radial direction beyond the body when the flap is in the second position.

In some embodiments, the flap extends at a predetermined angle with respect to the longitudinal axis when the flap is in the second position.

In some embodiments, the flap extends a predetermined distance in a longitudinal direction beyond the body when the flap is in the second position.

In some embodiments, the flap release mechanism releases the flap from the first position to the second position in response to a predetermined event.

According to another aspect of the present disclosure, a tail for a projectile is provided. In some embodiments, the tail includes a body having a longitudinal axis and a steering assembly secured to the body. In some embodiments, the steering assembly includes a flap movable from a first position in which the flap does not extend radially beyond the body to a second position in which the flap extends radially beyond the body and at an angle relative to the longitudinal axis; and a flap release mechanism.

In some embodiments, the flap extends a predetermined distance in a radial direction beyond the body when the flap is in the second position.

In some embodiments, the flap extends at a predetermined angle with respect to the longitudinal axis when the flap is in the second position.

In some embodiments, the flap extends a predetermined distance in a longitudinal direction beyond the body when the flap is in the second position.

In some embodiments, the flap release mechanism releases the flap from the first position to the second position in response to a predetermined event.

In some embodiments, the predetermined event is a pyrotechnic event.

In some embodiments, the pyrotechnic event is activation of a pyrotechnic charge.

In some embodiments, the flap has a free end and a fixed end, the fixed end being connected to the body by a hinge.

In some embodiments, the fixed end is rearward of the free end in a direction parallel to the longitudinal axis when the flap is in the first position.

In some embodiments, the free end is rearward of the fixed end in a direction parallel to the longitudinal axis when the flap is in the first position.

In some embodiments, the flap is secured to a fixed flap that is formed on the body.

In some embodiments, the tail further comprises a plurality of strakes on the body. According to another aspect of the present disclosure, a projectile is provided. In some embodiments, the projectile includes a front portion; a connection mechanism connected to the front portion; and a tail portion connected to the connection mechanism. In some embodiments, the tail portion includes a body having a longitudinal axis; a plurality of strakes on the body; and a steering assembly secured to the body. In some embodiments, the steering assembly includes a flap movable from a first position in which the flap does not extend radially beyond the body to a second position in which the flap extends radially beyond the body and at an angle relative to the longitudinal axis; and a flap release mechanism.

According to another aspect of the present disclosure, a projectile, comprises a front portion; a connection mechanism connected to the front portion; and a tail portion connected to the connection mechanism. In some embodiments, the tail portion includes a body having a longitudinal axis; and a steering assembly secured to the body. In some embodiments, the steering assembly includes a flap movable from a first position in which the flap does not extend radially beyond the body to a second position in which the flap extends radially beyond the body and at an angle relative to the longitudinal axis; and a flap release mechanism.

In some embodiments, the flap extends a predetermined distance in a radial direction beyond the body when the flap is in the second position.

In some embodiments, the flap extends at a predetermined angle with respect to the longitudinal axis when the flap is in the second position.

In some embodiments, the flap extends a predetermined distance in a longitudinal direction beyond the body when the flap is in the second position.

In some embodiments, the flap release mechanism releases the flap from the first position to the second position in response to a predetermined event.

In some embodiments, the predetermined event is a pyrotechnic event.

In some embodiments, the pyrotechnic event is activation of a pyrotechnic charge.

In some embodiments, the flap has a free end and a fixed end, the fixed end being connected to the body by a hinge.

In some embodiments, the fixed end is rearward of the free end in a direction parallel to the longitudinal axis when the flap is in the first position.

In some embodiments, the free end is rearward of the fixed end in a direction parallel to the longitudinal axis when the flap is in the first position.

In some embodiments, the flap is secured to a fixed flap that is formed on the body.

In some embodiments, the projectile further comprises a plurality of strakes on the body. According to another aspect of the present disclosure, a target acquisition and tracking system is provided. In some embodiments, the target acquisition and tracking system comprises a command unit including at least one sensor and a transmitter; and at least one projectile. In some embodiments, the projectile includes a receiver that is operable to receive instructions from the transmitter of the command unit, a tail, and a controller. In some embodiments, the tail comprises a body having a longitudinal axis; and a steering assembly secured to the body. In some embodiments, the steering assembly includes a flap movable from a first position in which the flap does not extend radially beyond the body to a second position in which the flap extends radially beyond the body and at an angle relative to the longitudinal axis; and a flap release mechanism. In some embodiments, the controller is operable to cause the flap release mechanism to release the flap from the first position to the second position in response to instructions from the transmitter.

In some embodiments, the receiver is an RF receiver.

In some embodiments, the receiver is operable to receive an electromagnetic signal.

In some embodiments, the receiver is operable to receive a signal that is outside of the visible light spectrum.

In some embodiments, the controller deploys the flap solely in response to the signal from the command unit.

In some embodiments, the at least one projectile further comprises a plurality of strakes on the body.

DESCRIPTION OF THE DRAWINGS

The accompanying drawings are not intended to be drawn to scale. For purposes of clarity, not every component may be labeled in the drawings.

In the drawings.

DETAILED DESCRIPTION

Figure 1:
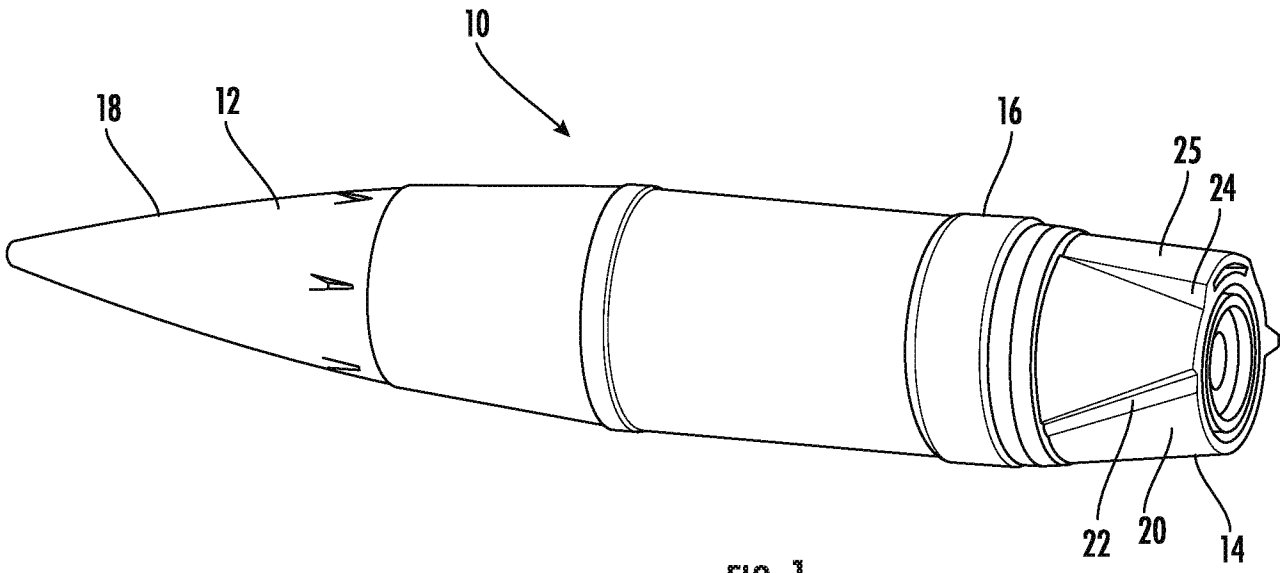
FIG. 1 illustrates an embodiment of a projectile according to the present disclosure with a flap in a first position.

State-of-the-art systems and methods for achieving short duration, high-G maneuvers include pyrotechnic devices such as squibs or gas mission systems using a reservoir of gas, or the ejection of selective mass items that would change the trajectory of a projectile because of the change in mass ejected from the outer sections of the projectile. None of these methods is practical, effective, affordable, or reliable. This is particularly the case for spin stabilized supersonic projectiles and more so for very small projectiles where the mechanisms for containing or dispensing gasses are difficult to achieve and the mechanisms for ejecting mass are equally challenging.

In some state-of-the-art projectiles, a "despun" tail kit on a standard guided projectile design has a fixed flap that is pre-selected for its size and angle. It may be specifically designed to maneuver adequately for the missions that can be addressed by the fire control system and the aerodynamic range of the projectile. However, some targets are at longer ranges, which for certain size projectiles such as a 30 millimeter round, may be greater than 5 kilometers, further than typical engagements, which may be in the range of 2 kilometers to 3 kilometers. Some targets may have greater velocity and evasive tactics, such as maneuvering unmanned aircraft systems (UASs) or incoming guided missiles.

These concepts could apply to projectiles that are larger than medium caliber projectiles, such as 120 mm projectiles and beyond.

During flight, a projectile experiences aerodynamic loads, including a gravitational force equivalent. The gravitational force equivalent, or, more commonly, G-force, is a measurement of the type of force per unit mass, typically acceleration, that causes a perception of weight, with a G-force of 1 g equal to the conventional value of gravitational acceleration on Earth, g, of about 9.8 $m/s^2$.

At long ranges nearing the end of the flight profile for new guided projectiles, the aerodynamic lift over the standard configuration of a projectile is diminished as the projectile transitions from high supersonic velocity to transonic and subsonic velocity. In order to make a terminal "closing maneuver" against a moving target or one that requires greater accuracy for effective lethal and damaging effects, there must be a means of increasing the momentary G-force on the tail of the projectile to execute the necessary maneuver. To solve this deficiency, aspects of the present disclosure relate to a projectile with a deployable flap. The deployable flap is also useful at closer distances to engage a rapidly maneuvering target or to compensate for an unexpected and extreme perturbation in the trajectory caused by the wind or other forces. While not suffering a decrease in maneuvering capability, the requirement for an extreme maneuver is met by deploying the deployable flap feature.

Systems and methods for maneuvering a tail portion of a projectile are provided. The systems and methods of the present disclosure may be utilized alone or in combination with a front portion of a projectile that may be fired from a weapon, such as a gun having a barrel.

According to an aspect of the present disclosure, a projectile includes a tail portion that includes a steering assembly.

At least some embodiments of the projectile of the present disclosure include a tail portion that is capable of altering the path of the projectile to cause the projectile to impact a moving target. At least some embodiments of the projectile of the present disclosure include a tail portion that is capable of altering the path of a projectile to cause the projectile to impact accurately a target that is far away. At least some embodiments of the projectile of the present disclosure include a tail portion that allows for the projectile to abruptly change its flight path from a ballistic flight path or from a flight path that is being controlled by other guidance functions controlling the trajectory of the projectile.

In some embodiments, the projectile may be launched from a weapon, such as a gun. In some embodiments, the projectile may be a bullet that is fired from a barrel, such as a rifled barrel. In some embodiments, the bullet is a 30 millimeter bullet or a larger caliber bullet. In some embodiments, the projectile is a ballistic projectile other than a bullet.

In some embodiments, the projectile includes a front portion, or a leading portion. In some embodiments, the front portion is configured to pierce an object on impact. In some embodiments, the front portion has a point detonating fuse that triggers a warhead within the projectile to explode when the fuse contacts a target. In some embodiments, a proximity sensor in the projectile triggers detonation of a warhead within the projectile when the projectile is within a predetermined distance of a target. In some embodiments, the projectile can be detonated by a command received from the firing control system. In some embodiments, the front portion is dimensioned as a leading end of a bullet.

In some embodiments, the front portion is made of metal and/or any material capable of being used in a bullet. In some embodiments, the front portion is a uniform material. In some embodiments, the front portion includes layers formed of different materials.

The front portion is connectable to a tail portion via a connection mechanism. The connection mechanism may be any connection that allows independent rotation of the front portion and the tail section. The connection mechanism allows the tail section to despin freely to near zero rotation with respect to the Earth. Therefore, the maneuvering features, such as a fixed flap or a deployable flap, can be controlled electronically to position them at any location over 360 degrees with respect to the axis of the projectile to impart the aerodynamic lift that turns the projectile in the instantaneous direction that creates a trajectory that intersects with the target with very low miss distance.

The connection mechanism provides the least amount of torque between the front portion and the tail portion in order to conserve energy when controlling the radial position of the tail portion with respect to the direction of gravity.

In some embodiments, the connection mechanism includes one or more bearings. The one or more bearings may be included in the front portion and/or in the tail portion. In some embodiments, the connection mechanism includes a joint that allows the front portion to rotate independently of the tail portion.

The connection mechanism can be made of metal and/or another material.

The tail portion allows the bullet to be steered as it travels towards an intended target.

In some embodiments, the tail portion includes a body. In some embodiments, the body includes a longitudinal axis. In some embodiments, the tail portion has a substantially cylindrical shape. In some embodiments, a trailing end of the tail portion is tapered radially inwardly. In some embodiments, the trailing end of the tail portion has a frustoconical portion that tapers radially inwardly from a substantially cylindrical portion.

As the body of the tail portion travels through a rifled barrel, a spin is imparted on the body. In some embodiments, the tail portion may include one or more structures that cause the tail portion to slow this spin with respect to the front portion when the projectile enters the airstream. In some embodiments, strakes (aerodynamic "fins" that protrude from the surface of the tail portion and are located at an angle with respect to the axial direction of the front body) are included on the tail portion to slow the spin. The strakes will decrease the spin of the tail section to zero with respect to the direction of gravity at which time an electronic control system will determine the motion of the tail portion such that the aerodynamics result in a change of direction which has been determined by calculations for a trajectory intended to intercept a target. Because the connection mechanism allows for rotation of the front portion relative to the tail portion, this slowing or stopping of the spin of the tail portion does not appreciably slow or stop the spin of the front portion. In some embodiments, the strakes and/or other control surfaces on the body are configured to orient the body of the tail portion in a desired orientation relative to a surface above which the projectile is traveling.

The electronic control system may include a processor, a memory component, a receiver, and/or a transmitter. The receiver may be a radio frequency (RF) receiver or another receiver. The receiver is configured to receive instructions from an external source. The processor is configured to provide a command to an aerodynamic steering assembly based on the received instructions. In some embodiments, the control system includes one or more sensors, and the processor is configured to provide a command to the aerodynamic steering assembly in response to on one or more signals from the one or more sensors. In some embodiments, the control system further includes an actuator to move a component, such as a flap, of the aerodynamic steering assembly in response to a command from the processor.

The tail portion includes the aerodynamic steering assembly. In some embodiments, the aerodynamic steering assembly includes a flap. In some embodiments, the steering assembly is secured of machined as a part of the body. In some embodiments, the steering assembly may be housed within the body. In some embodiments, the steering assembly may be partially housed within the body of the tail portion.

In some embodiments, the steering assembly includes a deployable flap. In some embodiments, the deployable flap is movable from a first position to a second position.

In some embodiments, when the deployable flap is in the first position, it does not extend radially beyond the body of the tail portion. In this way, the deployable flap in the first position does not affect the aerodynamic profile of the projectile until it is deployed when the projectile travels along a path to which the longitudinal axis of the body is tangential.

In some embodiments, an outer surface of the deployable flap forms part of an outer surface of the aerodynamic flap feature on tail portion when the deployable flap is in the first position. In some embodiments, the outer surface of the deployable flap may coincide with the cylindrical or conical shape of the projectile. In some embodiments the outer surface of the deployable flap may be flat provided that the deployable flap is contained within the caliber of the bullet. In some embodiments, the inner surface of the deployable flap may be a cylindrical or conical shape offset from the outer surface of the deployable flap. In some embodiments, the inner surface of the deployable flap may be flat.

In some embodiments, the deployable flap is secured to the body at a hinge at a front end of the deployable flap when the deployable flap is in the first position, and the deployable flap pivots about the hinge away from the longitudinal axis of the body. When the deployable flap is moved to the second position, the angle of the deployable flap relative to the longitudinal axis of the body is an acute angle about an arc along a path from the first position to the second position. If the deployable flap and the longitudinal axis of the body form an angle that is too small, the deployable flap will not cause a desired change in trajectory of the projectile. If the deployable flap and the longitudinal axis of the body form an angle that is too large, the deployable flap can cause an undesirable change in trajectory of the projectile. The desired deployable flap angle is determined by aerodynamic modeling and testing to provide sufficient and greatly increased aerodynamic lift for a short duration change of direction that decreases the miss distance at the intercept point with the target. In some embodiments, the deployable flap pivots about the hinge so the deployable flap forms an angle in the range of, for example, 10° to 60° with the longitudinal axis of the body when the deployable flap is in the second position. In some embodiments, the deployable flap pivots about the hinge so the deployable flap forms an angle in the range of 20° to 40° with the longitudinal axis of the body when the deployable flap is in the second position. In some embodiments, the deployable flap pivots about the hinge so the deployable flap forms an angle of 30° relative to the longitudinal axis of the body when the deployable flap is in the second position. The selection of the desired angle is based on the mission requirements of the projectile and the velocity and range at which it is expected to be used for terminal maneuvers.

The flap is configured to be deployed to provide a desired mission performance. The flap may be configured to enable the projectile to have a desired maneuverability. The flap may be configured to cause the projectile to travel at a desired velocity and/or to travel a desired distance.

The G-force provided by a flap is related to the velocity of the projectile when the flap is deployed. For a given projectile having a given launching force, if the flap is deployed early in the flight path the flap will provide a relatively high G-force. For the same projectile having the same launching force, if the flap is deployed later in the flight path, the flap will provide a relatively low G-force because the projectile slows down due to drag over the flight path of the projectile.

The G-force provided by a flap is also related to the surface area of the flap that engages the airstream around the projectile. A first flap may be configured to provide a desired G-force for a projectile at a first velocity. To provide the same G-force for the same projectile at a second velocity that is slower than the first velocity, the projectile would need to deploy a greater amount of flap surface area into the airstream.

In some embodiments, for example, a flap may allow a projectile to maneuver with a G-force of 7G rather than 0.7G without the flap.

A spring or other capture mechanism may be used to assist the deployment of the flap that is hinged in the front and to retain the flap in the final deployed position.

In some embodiments, the deployable flap is secured to the body at a hinge at a rear end of the deployable flap when the deployable flap is in the first position, and the deployable flap pivots about the hinge away from the longitudinal axis of the body. When the deployable flap is moved to the second position, the angle of the deployable flap relative to the longitudinal axis of the body is an obtuse angle about an arc along the path from the first position to the second position. If the deployable flap and the longitudinal axis of the body form an angle that is too large, the deployable flap will not cause a desired change in trajectory of the projectile. If the deployable flap and the longitudinal axis of the body form an angle that is too small, the deployable flap can cause an undesirable change in trajectory of the projectile. In some embodiments, the deployable flap pivots about the hinge so the deployable flap forms an angle in the range of 120° to 170° relative to the longitudinal axis of the body when the deployable flap is in the second position. In some embodiments, the deployable flap pivots about the hinge so the deployable flap forms an angle in the range of 140° to 160° relative to the longitudinal axis of the body when the deployable flap is in the second position. In some embodiments, the deployable flap pivots about the hinge so the deployable flap forms an angle of 150° relative to the longitudinal axis of the body when the deployable flap is in the second position. A capture mechanism may be used to secure the flap in the deployed position. Aerodynamic forces assist the deployment of the flap once it is released from the undeployed position within the tail portion.

In embodiments in which the deployable flap is secured to the body at a hinge at the rear end of the deployable flap, an airstream passing the body during flight of the tail portion helps to maintain the deployable flap in a deployed position, such as the second position, rather than in the first position. For example, in some embodiments, the deployable flap includes a lip that induces drag on the deployable flap. Once the flap is released, the drag of the airstream on the lip forces the deployable flap in a direction that prevents the deployable flap from reverting to the first position.

In some embodiments, when the deployable flap is in a first position, the deployable flap is retained within a recess that is defined in the body. The deployable flap is slidable with respect to the recess, and the deployable flap is movable from the first position to a second position, in which the deployable flap protrudes from the recess.

In some embodiments, the deployable flap is secured within a recess in the body and does not extend radially beyond an outer surface of the tail portion when the deployable flap is in the first position. In some embodiments, the deployable flap translates with respect to the tail portion so that the deployable flap extends radially beyond the outer surface of the tail portion when the deployable flap is in the second position. In some embodiments, the deployable flap translates from the first position to the second position in a direction that is orthogonal with respect to the longitudinal axis of the projectile, about which the projectile rotates when it exits a barrel. In other embodiments, the deployable flap translates in another direction with respect to the tail portion so that a front surface on the deployable flap is in a desired position and orientation with respect to the projectile when the deployable flap is in the second position.

If a front surface on the deployable flap and the longitudinal axis of the body form an angle that is too small, the deployable flap will not cause a desired change in trajectory of the projectile. If the front surface on the deployable flap and the longitudinal axis of the body form an angle that is too large, the deployable flap can cause an undesirable change in trajectory of the projectile. The desired angle between the front surface on the deployable flap and the longitudinal axis of the projectile is determined by aerodynamic modeling and testing to provide sufficient and greatly increased aerodynamic lift for a short duration change of direction that decreases the miss distance at the intercept point with the target. In some embodiments, the front surface on the deployable flap forms an angle that is useful for providing a desirable amount of lift. In some embodiments, the front surface on the deployable flap forms an angle in the range of, for example, about 1° to about 179° with the longitudinal axis of the projectile when the deployable flap is in the second position. In some embodiments, the front surface on the deployable flap forms an angle in the range of about 85° to about 95° with the longitudinal axis of the projectile when the deployable flap is in the second position. In some embodiments, the front surface of the deployable flap forms an angle of 90° relative to the longitudinal axis of the body when the deployable flap is in the second position. The selection of the desired angle is based on the mission requirements of the projectile and the velocity and range at which the projectile is expected to be used for terminal maneuvers.

The flap thickness in the longitudinal direction of the tail portion can be selected from a wide variety of thicknesses. For example with a 30 millimeter projectile, on the low end the flap thickness could be about 0.01*D, where D is the nominal diameter of the projectile such as 30 millimeters, because a thinner flap would not support sufficiently high aerodynamic loads. On the high end for a 30 millimeter projectile, the flap thickness could be about 0.30*D, because thicker flaps reduce the available packaging volume within tail. The flap thickness may be selected to provide a sufficiently rigid aerodynamic surface. In some embodiments, for example with a 30 millimeter projectile, the deployable flap has a thickness in the longitudinal direction of the tail portion that is in the range of about 0.01*D to about 0.20*D; the thickness may be in the range of about 0.05*D to about 0.10*D; the thickness may be in the range of about 0.06*D to about 0.08*D; in one embodiment, the thickness is 0.07*D. It should be recognized that other flap thicknesses within these ranges could be used depending on the circumstances of the use and the intended purpose. The thickness may be selected based on aerodynamic modeling and desired aerodynamic performance of the projectile, as well as the material properties of the deployable flap.

The height that the flap extends beyond the outer surface of the tail portion can be selected from a wide variety of heights. On the low end, the height could be about 0.01*D, because shorter height would not provide sufficient drag. On the high end, the height could be about 0.40*D, because a greater height would provide too much drag. The height may be selected to provide a desired amount of drag. In some embodiments, for example with a 30 millimeter projectile, the deployable flap extends beyond the outer surface of the tail portion by a height that is in the range of about 0.01*D to about 0.40*D, where D is the nominal diameter of the projectile, such as 30 millimeters; the height may be in the range of about 0.05*D to about 0.15*D; the height may be in the range of about 0.08*D to about 0.12*D; in one embodiment, it is 0.09*D. It should be recognized that other heights within these ranges could be used depending on the circumstances of the use and the intended purpose. The height may be selected based on aerodynamic modeling and desired aerodynamic performance of the projectile.

The embodiments disclosed herein are only exemplary embodiments. The dimensions disclosed herein are scalable. Different flap angles provide different magnitudes of maneuvering force. The flap may be configured to provide a desired G-force. The desired G-force may be selected based on mission parameters for a projectile and aerodynamics of the projectile. Mission parameters may include the desired velocity of the projectile during its flightpath to a target, and the desired distance that the projectile travels to the target.

In some embodiments, for example with a 30 millimeter projectile, the deployable flap extends from a recess in a fixed flap on the tail portion and, in some embodiments, the deployable flap is narrower than the fixed flap. The width of the flap can be selected from a wide variety of widths. On the low end, the width could be about 0.10*D, because smaller widths do not provide enough drag. On the high end, the width could be about 1.00*D, because a greater width would provide too much drag. The width may be selected to provide a desired amount of drag. In some embodiments, for example with a 30 millimeter projectile, the width of the deployable flap may be in the range of about 0.10*D to about 1.00*D when viewed from the rear end of the tail portion, where D is the nominal diameter of the projectile, such as 30 millimeters; the width may be in the range of about 0.30*D to about 0.60*D when viewed from the rear end of the tail portion; the width may be in the range of about 0.40*D to about 0.50*D when viewed from the rear end of the tail portion; in some embodiments, the width is 0.44*D when viewed from the rear of the tail portion. The width may be selected based on aerodynamic modeling and desired aerodynamic performance of the projectile. It should be recognized that other widths within these ranges could be used depending on the circumstances of the use and the intended purpose.

In some embodiments, the projectile is a 30 millimeter projectile, and the flap is configured to increase the G-force at the end of the flight from less than 1 G to between about 6 G and about 8G.

The distance that the flap is offset from the rear edge of the tail portion can be selected from a wide variety of distances. For equivalent flap size, a flap is more effective (provides larger G-force or acceleration for turning or maneuvering) when it is positioned further away from the center of gravity (CG) of the projectile. This is because the pitching moment or torque generated by the flap is the product of its lift or normal force and moment arm, the CG offset to the flap's center of pressure being the moment arm. Greater pitching moment equates to a larger trim angle of attack for the projectile and greater body lift, which is what provides the maneuvering acceleration. On the low end, the distance could be about 0.00*D, because it provides a low turning radius. On the high end, the distance could be about 2.00*D, because a greater distance would provide too large a turning radius. The distance may be selected to provide a desired turning radius. In some embodiments, for example in a projectile such as a 30 millimeter projectile, the deployable flap is offset by a distance in the range of about 0.00*D to about 2.00*D, where D is the nominal diameter of the projectile, such as 30 millimeters; the distance may be in the range of about 0.01*D to about 0.75*D from the rear edge of the tail portion; the distance may be in the range of about 0.02*D to about 0.25*D from the rear edge of the tail portion; in one embodiment, it is offset by a distance of 0.04*D from the rear edge of the tail portion. It should be recognized that other distances within these ranges could be used depending on the circumstances of the use and the intended purpose. The distance may be selected based on aerodynamic modeling and desired aerodynamic performance of the projectile The dimensions of the deployable flap and the fixed flap may be selected based on aerodynamic modeling and testing to provide the desired aerodynamic lift for a short duration change of direction.

In the first position, the deployable flap is recessed so that it does not extend beyond the outer dimensions of the projectile until a change in direction (a maneuver) is required to reduce the miss distance from the target. At that time, the flap is released by a release mechanism.

A release mechanism can be used in conjunction with any of the embodiments of the present disclosure to release the deployable flap from the first position so the deployable flap can rotate, translate, or otherwise move from a first position to a second position.

In some embodiments, the release mechanism releases the flap from the first position in response to a predetermined event.

In some embodiments, the release mechanism is an electrically-activated mechanical lock mechanism, a meltable fuse-like retainer, and/or some other method of capture that holds the deployable flap in the first position. In some embodiments, the flap release mechanism includes a meltable material or a burn-through material. In some embodiments, the material is in the form of a tape or a wire. The material in the release mechanism may be sized and shaped and may be formed from a metal and/or a metal alloy, or similar material to allow for secure positioning of the flap in a first position while also being capable of breakage, weakening, or melting to allow for release of the flap into a second position. This functionality would require the material to have, for example, a melting point sufficiently high enough to support the flap during at least the initial flight of the projectile.

One example of a material that can be included in the release mechanism is a common Nichrome alloy. Nichrome is an alloy of nickel and chromium, and often includes iron and other substances. One version of this material, Nichrome (80-20) has a melting point of about 1,400° C. A thin version of the material may have sufficient mechanical strength to reliably survive the launch of the projectile prior to the application of sufficient current to melt the metal when desired.

In some embodiments of a release mechanism, Nichrome wire may be used to retain the deployable flap in the first position, and the predetermined event is the melting of the Nichrome wire. In some embodiments, when the Nichrome wire is melted, a spring advances the deployable flap from the first position to the second position. In some embodiments, the release mechanism includes a feature that grips a surface of the deployable flap when the deployable flap is in the first position, and then releases the surface of the deployable flap to allow the deployable flap to move to the second position. In some embodiments, the feature that grips the surface of the deployable flap includes a serrated feature, a textured feature, a stepped surface, or another gripping surface.

In some embodiments, the control system sends a command to cause a pyrotechnic event to release the flap. In an example of a pyrotechnic event, a pyrotechnic charge deflagrates on command, such as in response to a command from the electronic control system. In some embodiments, pins hold the flap in a first position with respect to the tail portion. When the pyrotechnic charge deflagrates, the flap is propelled outward by the pressure increase, which causes the flap to sever the pins. Thus, the pyrotechnic charge releases the flap from the first position. In some embodiments, the pins are metal rods made from alloys such as copper or another material, such that the pins are strong enough to retain the flap in the first position but weak enough to be sheared by deflagration of the pyrotechnic charge.

In some embodiments, the predetermined event is temporal. In some embodiments, the predetermined event occurs when a temperature is measured by a sensor in communication with the release mechanism. In some embodiments, other factors are used as, or in combination with, the predetermined event.

In the second position the deployable flap extends radially beyond the body. In this way, the deployable flap extends into the airstream when the projectile travels along a path to which the longitudinal axis of the body is tangential. In some embodiments, the airstream also provides forces that pull the deployable flap to the rear of the projectile, at an angle and greater radial distance from the center-line of the projectile, so that much greater aerodynamic G-force is applied to the tail of the projectile, causing an abrupt maneuver to initiate. In some embodiments, the deployable flap extends beyond the diameter of the main body of the projectile to apply several times the G-force available or more than that which would have been available from a fixed flap.

In some embodiments, in the second position, the deployable flap extends a predetermined distance in a radial direction beyond the body. In some embodiments, in the second position, the deployable flap extends at a predetermined angle with respect to the longitudinal axis of the body. In some embodiments, in the second position, the deployable flap extends a predetermined distance in a longitudinal direction beyond the body. The degree of extension is determined by careful analysis of the aerodynamic stability of the projectile at the time during flight when it is extended. Typically, the flap extension would not be greater than 20 to 30 percent of the radius of the round though for some angles and circumstances it may exceed that amount. That is, in some embodiments, when the flap is in a deployed position, the furthest point on the flap measured from the longitudinal axis of the projectile extends between 1.2 and 1.3 times the maximum radius of the projectile itself.

In some embodiments, the deployable flap is a small feature relative to the size of the projectile. In various embodiments, the dimensions of the deployable flap are selected to have the proper design for angle of the deployable flap with respect to a longitudinal axis of the projectile, length of the deployable flap, width of the deployable flap, and deployed mechanical stability of the deployable flap.

The size of the deployable flap relative to the size of the projectile is determined by the modeling and aerodynamics for the projectile and the mass properties of the projectile. More force is required to move larger masses in a new direction. Any abrupt change in direction impacts the flight stability of the projectile depending on the distance the projectile has already flown. At greater distances, the spin of the front portion of the projectile is slowing down and the gyroscopic stability is decreasing. Similarly, the velocity of the projectile is slowing down so that the force generated by the undeployed flap is decreasing, and the undeployed flap is less able to make any critical final maneuvers. In such a case, a deployed flap could increase the lateral force by up to 10× or more. While the projectile may have 4-5 Gs (or more) of maneuvering force when it is traveling quickly as the projectile leaves the barrel, at the end of a long flight that force might be less than 1 G. But a 0.7 G end of flight maneuvering force could be momentarily raised to 7 Gs with the flap for a final closing maneuver. The downside is that the projectile becomes quickly unstable, but the projectile is intentionally designed to reach instability after the projectile impacts its target.

In some embodiments, the deployable flap is made from metal. In some embodiments, the deployable flap is made from graphite-epoxy composite or another suitably strong material.

In some embodiments, the location of the deployable flap in a deployed position can be controlled to accomplish a desired maneuver in the same manner as the undeployed maneuvering feature, including what is referred to as a "wiper mode" control approach. This imparts a G-force distributed over a selectable range of radial angles of the tail section location and "wiped" back and forth at a predetermined repetitive rate, which results in a G-force vector that is less than the force that would be achieved if the flap feature was placed at a single position. This enables a range of turning maneuvers from soft (slow) to hard (abrupt) turns.

In the "wiper mode control approach," the position of the flap is rotated back and forth about a longitudinal axis of the projectile between a first orientation and a second orientation. For example, the position of the flap is rotated back and forth between the 12 o'clock orientation with respect to the longitudinal axis of the projectile and the 4 o'clock orientation with respect to the longitudinal axis. This causes the projectile to deflect in the same direction it would if the flap were oriented at the 2 o'clock position, but the maneuver is less abrupt than it would be if the flap were oriented at the 2 o'clock position.

In an approximated "wiper mode control approach," the position of the flap is rotated in a single direction with respect to the longitudinal axis of the projectile, but the speed of the rotation changes over its angular sweep. For example, rotating the flap at a first speed between the 12 o'clock position and the 4 o'clock position and then rotating the flap at a second speed that is faster than the first speed between the 4 o'clock position and the 12 o'clock position will cause the projectile to deflect in the same direction it would if the flap were oriented at the 2 o'clock position, but the maneuver is less abrupt than it would be if the flap were oriented at the 2 o'clock position. The approximated "wiper mode control approach" causes a less abrupt maneuver than the "wiper mode control approach."

In some embodiments, the tail portion of the projectile includes a locking mechanism to retain the deployable flap in the second position. In some embodiments, the tail portion of the projectile includes a locking mechanism to retain the deployable flap in one or more positions in addition to the fully-deployed second position. For example, in some embodiments, the locking mechanism is capable of retaining the deployable flap in one or more intermediate positions between the first position and the second position. These intermediate positions could be made selectable by other mechanical or electronic means.

The locking mechanism prevents movement of the deployable flap from a deployed position, such as the second position or one of the intermediate positions, to the first position.

In some embodiments, the locking mechanism includes a capture mechanism. Once deployed, the flap locks in place via the capture mechanism engaging the flap. In some embodiments, the capture mechanism includes a serrated surface to engage edges of the deployable flap. In some embodiments, the locking mechanism includes a mechanical lock with a spring or other positive contact device to prevent retraction of the flap. In some embodiments, the locking mechanism includes another electrical or mechanical capture mechanism to hold it in place.

One example of the benefit of a tail portion of the present disclosure is the ability to increase the turning capability of a projectile at broad range of velocities of the projectile. At a given velocity, usually immediately after emerging from the gun, a projectile has a maximum turning ability, which is measured by a maximum G-force the projectile can experience in a turn without changing its aerodynamic profile. In all embodiments, the deployable flap increases the G-force that a projectile can experience in a turn at a given velocity of the projectile. In all embodiments, the deployable flap can increase the G-force that a projectile can experience in a turn at a given velocity of the projectile by a factor that is in the range of about 3 to about 15. In some embodiments, the deployable flap can increase the G-force that a projectile can experience in a turn at a given airspeed of the projectile by a factor that is in the range of about 10 to about 15. In some embodiments, the deployable flap can increase the G-force that a projectile can experience in a turn at a given airspeed of the projectile by a factor of 10. In some embodiments, the deployable flap can increase the G-force that a projectile can experience in a turn at a given airspeed of the projectile by a factor that is in the range of about 12 to about 15.

According to another aspect of the present disclosure, a tail portion includes a steering assembly, and the tail portion is provided separately from a front portion, which is a leading portion of a projectile.

As illustrated in FIG. 1, a projectile 10 includes a front portion 12 and a tail portion 14 that are connected by a connection portion (internal to the projectile and not shown) that allows the front portion 12 to rotate with respect to the tail portion 14. In some embodiments, the connection portion includes a bearing or combination of two or more bearings.

The front portion 12 includes a substantially conical surface 18. In some embodiments, the front portion is dimensioned and configured to pass through a rifled barrel of a firearm so that the surface 16 of the front portion 12 engages the rifled barrel and both the front portion 12 and the tail portion 14 rotate as the projectile exits the barrel.

The tail portion 14 includes a tapered surface 20 and strakes 22, which help to de-spin the tail portion after the tail portion 14 exits a barrel of a firearm. The strakes 22 extend at an angle with respect to a longitudinal axis of the tail portion 14.

Figure 2:
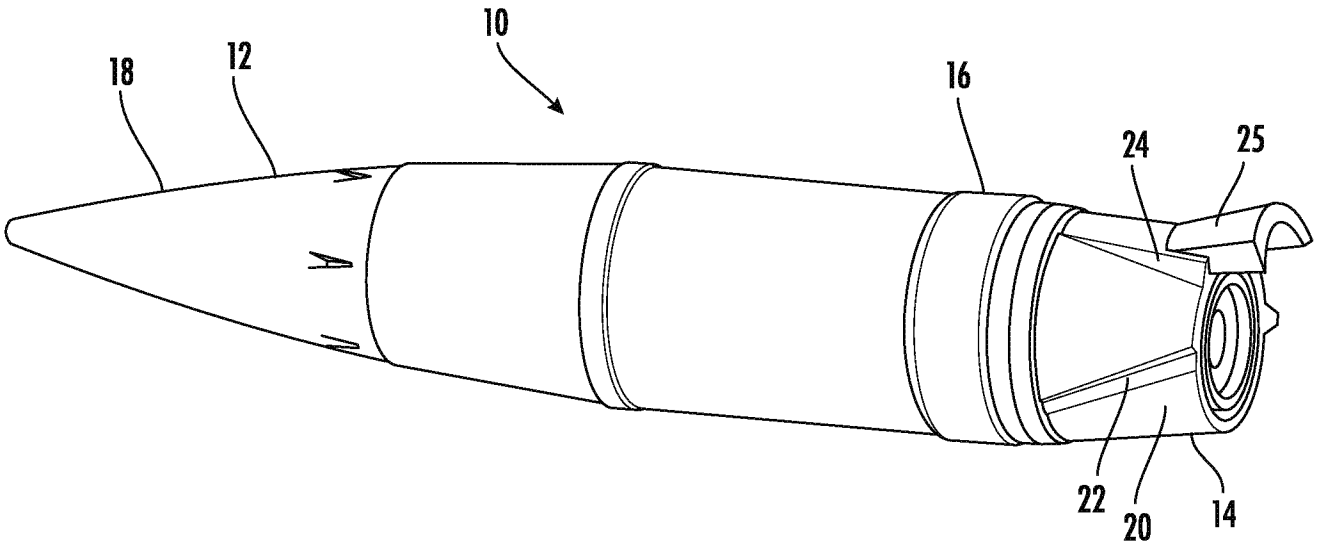
FIG. 2 illustrates the projectile of FIG. 1 with the flap in a second position.

The tail portion also includes a fixed flap portion 24 that contains a movable section that is a deployable flap 25, which is movable from the first position shown in FIG. 1 to a second position in FIG. 2. The deployable flap 25 can be deployed from the first position to the second position to deflect the projectile from a parabolic path. FIG. 2 shows the deployable flap has moved rearward with respect to the fixed flap portion 24 and is angled outwardly with respect to the fixed flap portion 24.

In some embodiments, during the initial flight of the projectile, the spin of the tail portion with respect to the front portion is slowed to around 10 cycles per second, such that aerodynamic turning forces from the fixed flap portion 24 are averaged out, and do not cause the projectile to turn in one direction. The fixed flap portion 24 can be used to provide initial G-forces for maneuvering, for example by using a wiper mode control of the fixed flap portion 24.

In the first position, the deployable flap 25 does not alter the aerodynamic maneuvering feature that supplies the initial G-forces for maneuvering as the projectile travels along a guided trajectory. In the second position, the deployable flap 25 extends radially beyond the maximum diameter of the front portion 12 and the maximum diameter of the connection portion 16. The deployable flap 25 extends axially rearward of the tail portion 14, so it is positioned in the airstream during flight of the projectile. In the second position of FIG. 2, this embodiment of the deployable flap 25 deflects the projectile from its guided trajectory so the projectile is re-directed more effectively during terminal maneuvers towards an intended target.

The deployable flap 25 is useful for increasing the G-force that the projectile can experience in a turn relative to the G-force that could be experienced in a turn caused by the fixed flap portion 24.

Figure 3:
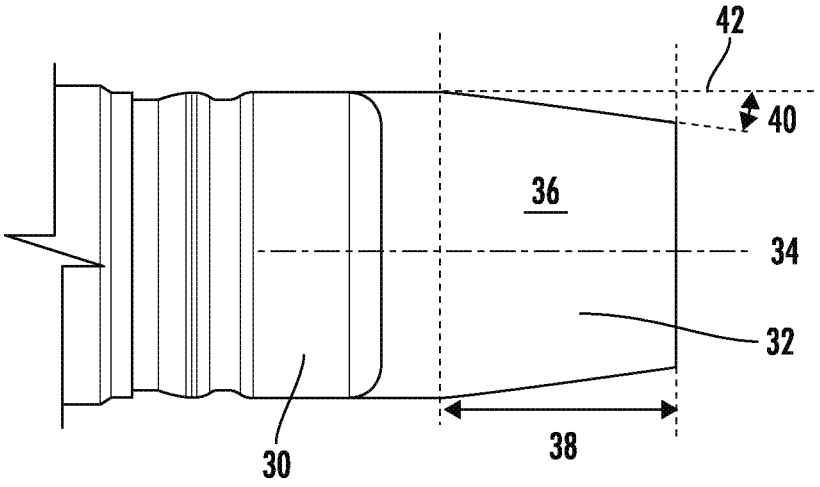
FIG. 3 illustrates a side view of an embodiment of a tail portion of a projectile to which a flap of the present disclosure may be applied.

FIG. 3 illustrates a side view of an embodiment of a tail portion 30 of a projectile to which a flap of the present disclosure may be applied. The tail portion 30 of FIG. 3 includes a tapered portion 32, which may be referred to as a "boat tail." The tail portion 30 has a longitudinal axis 34. The tapered portion 32 has a frustoconical surface 36. In the side view, the surface 36 of the tapered portion has a length 38 in the longitudinal direction and is tapered at an angle 40 with respect to a line 42 that is parallel to the longitudinal axis 34 of the tail portion 30. The length 38 and the angle 40 may be selected to provide desired aerodynamic performance of the projectile. The length 38 can be selected from a wide variety of lengths. On the low end, the length could be about 0.10 times the caliber of the projectile, because shorter lengths do not provide enough additional G-force to intercept targets that may have greater velocity and evasive tactics, such as maneuvering unmanned aircraft systems (UASs) or incoming guided missiles. On the high end, the length could be about 2.00 times the caliber of the projectile before developing too much drag force which would cause the projectile to slow to a point where it could not intercept a target such as a maneuvering unmanned aircraft system (UAS) or incoming guided missile. The length may be selected to provide an optimal balance of increased G-force to maneuver the projectile while minimizing drag so that the projectile maintains enough speed to maneuver effectively. In some embodiments, the length 38 is between about 0.10 times the caliber of the projectile to about 2.00 times the caliber of the projectile. In some embodiments, the length 38 is between about 0.20 times the caliber of the projectile to about 1.50 times the caliber of the projectile. In some embodiments, the length 38 is between about 0.30 times the caliber of the projectile to about 1.00 times the caliber of the projectile. In some embodiments, the length 38 is between about 0.20 times the caliber of the projectile to about 1.00 times the caliber of the projectile. In some embodiments, the length 38 is between about 0.30 times the caliber of the projectile to about 0.80 times the caliber of the projectile. In an example, the length is 0.77 times the caliber of the projectile. It should be recognized that other lengths within these ranges could be used depending on the circumstances of the use and the intended purpose.

The angle 40 can be selected from a wide variety of angles. On the low end, the angle could be about 0.0°, because no taper is required. On the high end, the angle could be about 20° because no appreciable reduction in drag is gained by greater angles, and greater angles reduce the physical packaging volume for the deployable flap. The angle may be selected to provide an optimal balance of minimizing drag and maximizing packaging volume. In some embodiments, the angle 40 is between about 0.0° and about 20.0°. In some embodiments, the angle 40 is between about 1.0° and about 15.0°. In some embodiments, the angle 40 is between about 2.0° and about 10.0°. In some embodiments, the angle 40 is between about 3.0° and about 10.0°. In an example, the angle 40 is about 7.0°. In some embodiments, the angle 40 is 0°, which means the tail of the projectile does not include a tapered portion. It should be recognized that other angles within these ranges could be used depending on the circumstances of the use and the intended purpose.

In an example, the length 38 is about 0.77 times the caliber of the projectile, and the angle 40 is about 7.0°.

The tail of the projectile may include a fixed flap. The fixed flap provides some maneuvering force to the projectile. In some embodiments, the fixed flap may be any non-axisymmetric feature relative to the longitudinal axis of the tail portion of the projectile. In other embodiments, the fixed flap may be an axisymmetric feature relative to the longitudinal axis of the tail portion of the projectile.

Figure 4A:
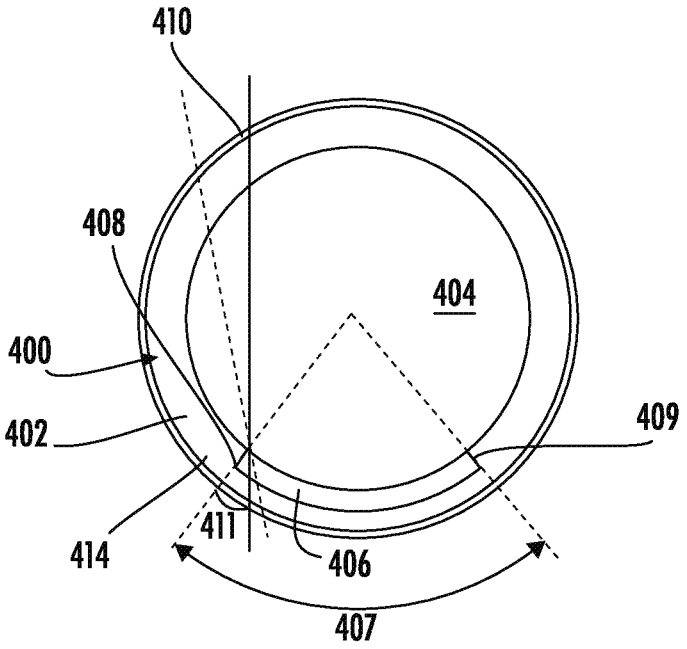
FIG. 4A illustrates a rear view of an embodiment of a tail portion having a fixed flap.

In FIG. 4A, a projectile 400 includes a tail portion 402 that is tapered inwardly towards a rear surface 404 of the tail portion. The tail portion 402 includes a fixed flap 406. The fixed flap 406 extends along an arc having a flap sector angle 407 perpendicular to the longitudinal axis of the tail portion.

The flap sector angle 407 can be selected from a wide variety of angles. On the low end, the flap sector angle could be about 10.0°, because this angle is the minimum required for the deployable flap to have the desired increased G-force and to be structurally stable. On the high end, the flap sector angle could be about 180°, because the flap must be sufficiently asymmetric to provide an increased G-force for maneuvering. The flap sector angle may be selected to provide a net asymmetry in a maneuvering direction. In some embodiments, the flap sector angle 407 is in the range of about 10.0° to about 180.0°. In some embodiments, the flap sector angle is in the range of about 30.0° to about 160.0°. In some embodiments, the flap sector angle is in the range of about 50.0° to about 140.0°. In some embodiments, the flap sector angle is in the range of about 70.0° to about 120.0°. In an example, the flap sector angle is about 80.0°. It should be recognized that other flap sector angles within these ranges could be used depending on the circumstances of the use and the intended purpose.

The fixed flap 406 includes side surfaces 408, 409. The side surfaces 408, 409 extend at a lean angle 411 relative to a vertical direction 410 when the tail portion 402 is viewed from the rear, as shown in FIG. 4A. In FIG. 4A, the lean angle 411 is negative. In some embodiments, the lean angle 411 is positive. In some embodiments, the lean angle 411 is in the range of about 0° to about 50°. In some embodiments, the lean angle 411 is in the range of about 0° to about 30°. In some embodiments, the lean angle 411 is in the range of about 0° to about 10°. In an example, the lean angle is about 0°.

In some embodiments, the lean angle for the side surface 408 is different from the lean angle for the side surface 409.

Figure 4B:
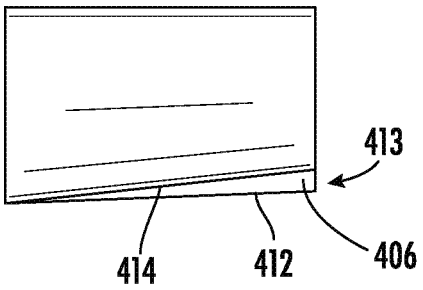
FIG. 4B illustrates a portion of a side view of the embodiment of FIG. 4B.

In the side view of FIG. 4B, the fixed flap 406 has an outer surface 412 that extends at a flap angle 413 relative to the frustoconical surface 414 of the tail portion. In some embodiments, the flap angle is in the range of about 0.0° to about 20.0°. In some embodiments, the flap angle is in the range of about 1.0° to about 15.0°. In some embodiments, the flap angle is in the range of about 2.0° to about 10.0°. In some embodiments, the flap angle is in the range of about 3.0° to about 5.0°. In an example, the flap angle is about 4.0°.

Figure 5A:
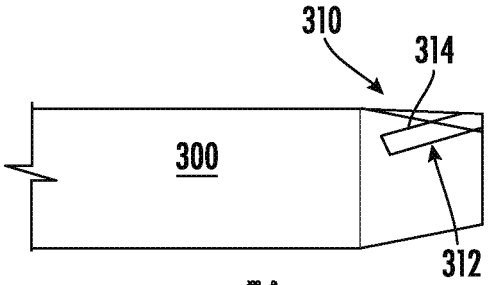
FIG. 5A illustrates a partial cross-sectional schematic view of a partial side view of an embodiment of a tail portion of a projectile according to the present disclosure with a flap in a first position.
Figure 5B:
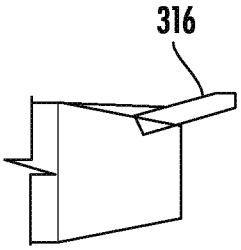
FIG. 5B illustrates a partial cross-sectional schematic view of a partial side view of the embodiment of the tail portion of FIG. 5A with the flap in a second position.

FIG. 5A shows a partial cross-sectional schematic view of a partial side view of another embodiment of a tail portion for a projectile 300. The tail portion includes a steering assembly 310 that includes a deployable flap 312. The deployable flap is movable from a first position, in which the deployable flap 312 is positioned in a recess 314 in FIG. 5A, to a second position in which the deployable flap extends radially outwardly and axially beyond the body of the tail portion in FIG. 5B.

In some embodiments, the deployable flap 312 is released from the first position to the second position by a material that retains the deployable flap in the first position. In some embodiments, when the material allows, a spring advances the deployable flap from the first position to the second position.

The deployable flap 312 includes a drag lip 316 to facilitate movement of the deployable flap from the first position to the second position. The drag lip 316 extends from an outer surface of the deployable flap 312. When the release mechanism causes the deployable flap to move from the first position to the second position, the deployable flap 312 enters the airstream around the tail portion in flight. The airstream exerts force on the drag lip 316, to help retain the deployable flap 312 in the second position, and prevent the deployable flap 312 from moving from the second position back to the first position until the airstream no longer exerts force on the drag lip 316.

Figure 6A:
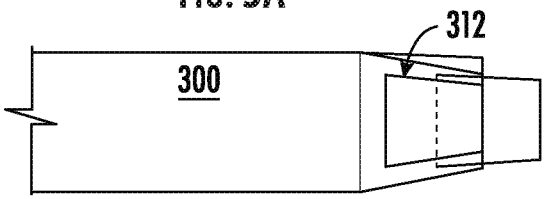
FIG. 6A illustrates a partial cross-sectional schematic view of a partial top view of the embodiment of the tail portion of FIG. 5A with the flap in the first position.
Figure 6B:
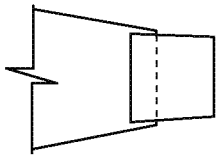
FIG. 6B illustrates a partial cross-sectional schematic view of a partial top view of the embodiment of the tail portion of FIG. 5A with the flap in the second position.

FIG. 6A shows a partial cross-sectional schematic view of a partial top view of the embodiment of the tail portion, with the deployable flap in the first position. FIG. 6B shows a partial cross-sectional schematic view of a partial top view of the embodiment of the tail portion with the deployable flap in the second position.

The deployable flap may be secured to the tail portion by a hinge. For example, the deployable flap may be secured to a fixed flap that is formed on the body of the tail portion. The flap may have a free end and a fixed end, with the fixed end being connected to the body by a hinge. In some embodiments, the fixed end is rearward of the free end in a direction parallel to the longitudinal axis when the flap is in the first position. In some embodiments, the free end is rearward of the fixed end in a direction parallel to the longitudinal axis when the flap is in the first position.

Figure 7A:
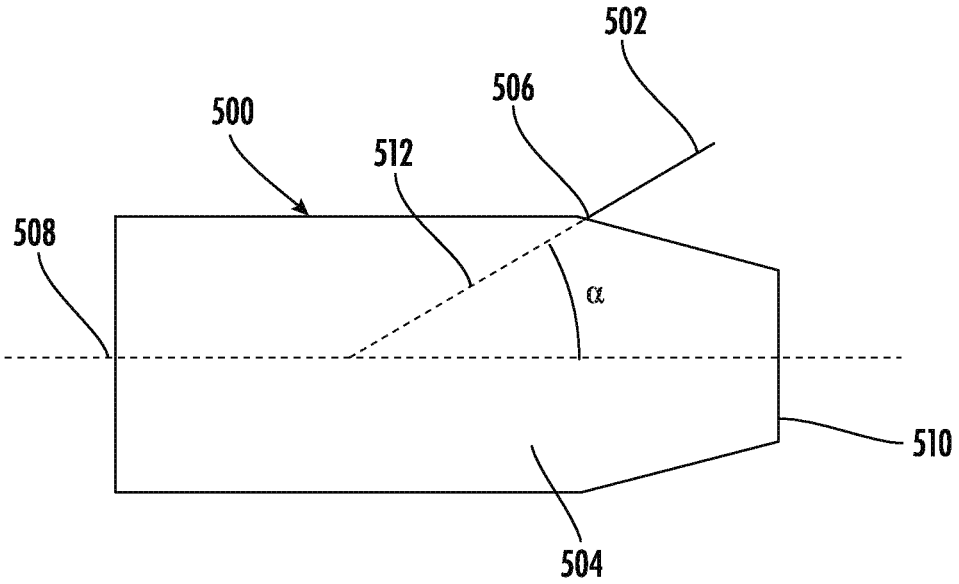
FIG. 7A illustrates a partial cross-sectional schematic view of a partial side view of an embodiment of a tail portion of a projectile according to the present disclosure with a flap hinged at a front end of the flap.

FIG. 7A illustrates a partial cross-sectional schematic view of a partial side view of an embodiment of a tail portion of a projectile 500 according to the present disclosure with a deployable flap 502 secured to a body 504 of the tail portion by a hinge 506 at a front end of the deployable flap 502. The deployable flap 502 pivots about the hinge 506 away from the longitudinal axis 508 of the body 504. When the deployable flap 502 is in the first position so the deployable flap 502 does not extend radially beyond the body 504 relative to the longitudinal axis 508, the free end of the deployable flap 502 is positioned between the hinge 506 and a rear end 510 of the body 504.

In FIG. 7A, the deployable flap 502 is rotated about the hinge 506 to a second position in which an axis 512 parallel to a control surface of the deployable flap 502 forms an acute angle $\alpha$ with the longitudinal axis 508 of the body 504.

The angle $\alpha$ can be selected from a wide variety of angles. On the low end, the angle could be about 2°, because a smaller angle will provide insufficient lift. On the high end, the angle could be about 90°, because a greater angle would provide insufficient lift. A 90° flap is similar to the "gurney tab" deployable flap shown in FIG. 9. Larger angles provide greater lift or normal force. The flap angle may be selected to provide a desired amount of lift. The angle $\alpha$ may be selected based on aerodynamic modeling of a projectile and the desired aerodynamic performance of the projectile. In some embodiments, the angle $\alpha$ is in the range of about 2° to about 70°. In some embodiments, the angle $\alpha$ is in the range of about 5° to about 60°. In some embodiments, the angle $\alpha$ is in the range of about 10° to about 50°. In some embodiments, the angle $\alpha$ is in the range of about 15° to about 30°. In one example, the angle $\alpha$ is about 15°. In another example, the angle $\alpha$ is about 30°. It should be recognized that other flap angles within these ranges could be used depending on the circumstances of the use and the intended purpose.

Figure 7B:
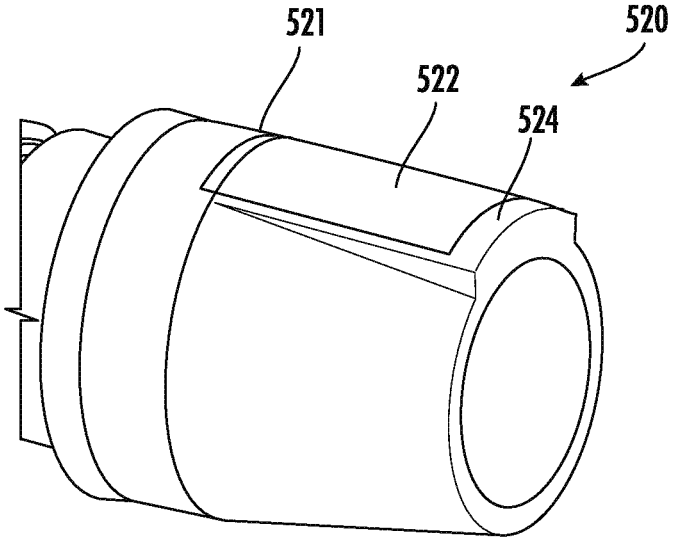
FIG. 7B illustrates a perspective view of an embodiment of a tail of a projectile with a flap in a first position.
Figure 7C:
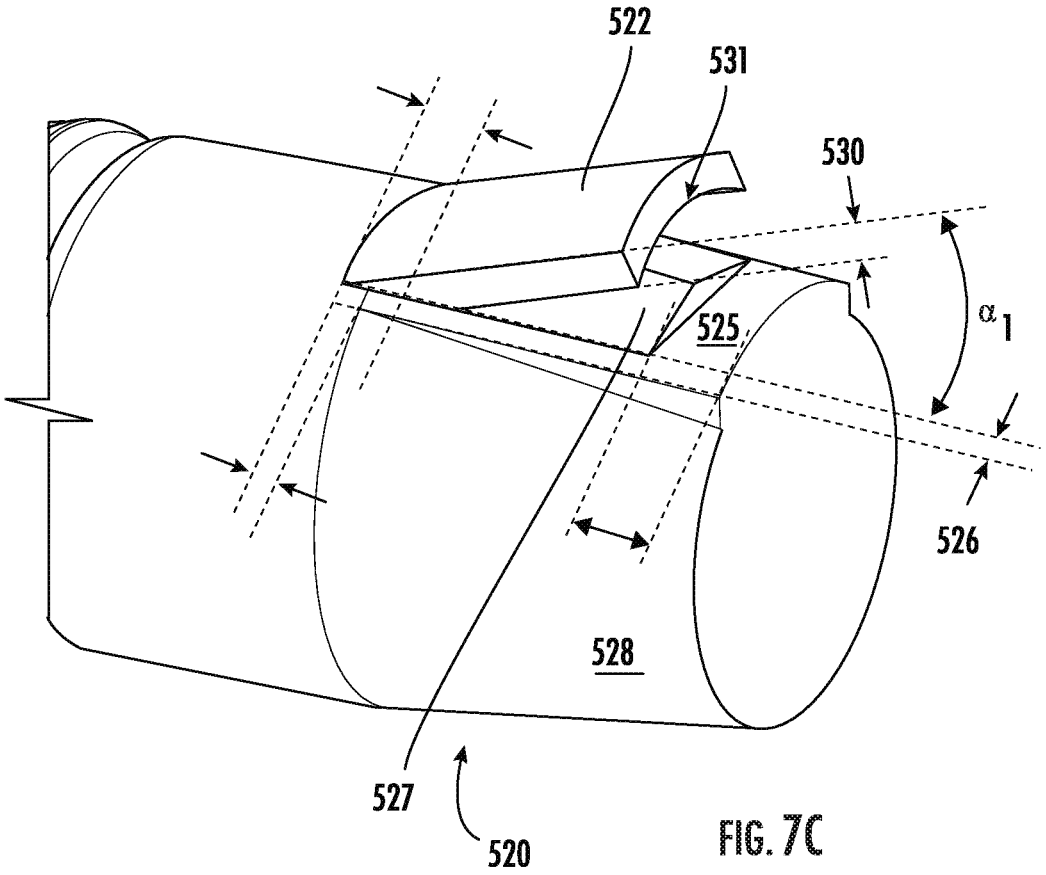
FIG. 7C illustrates a perspective view of the embodiment of FIG. 7B with the flap in a second position.

FIGS. 7B and 7C illustrate a tail portion 520 that includes a deployable flap 522 that is secured to the tail portion 520 by a hinge 521. The deployable flap 522 is shown in the stowed position in FIG. 7B. The deployable flap is shown in the deployed position in FIG. 7C. A pyrotechnic charge located, for example, at point 527 in FIG. 7C may cause the deployable flap 522 to move from the stowed position to the deployed position.

In FIG. 7C, the deployable flap 522 forms an angle $\alpha_1$ with the surface 525 of the fixed flap 524.

In the stowed position, the deployable flap 522 is seated in a recess defined in a fixed flap 524. The fixed flap 524 extends beyond the deployable flap 522 in a circumferential direction by a frame thickness 526 and extends beyond the deployable flap 522 in a longitudinal direction by an aft clearance 528. The frame thickness and the aft clearance may be selected based on aerodynamic modeling and desired aerodynamic performance of the projectile.

The frame thickness can be selected from a wide variety of thicknesses. On the low end, the frame thickness could be about 0.01*D, because a smaller frame thickness results in a larger flap that provides too much drag. On the high end, the frame thickness could be about 0.30*D, because a larger frame thickness results in a smaller flap that provides insufficient drag. The frame thickness may be selected to provide a desired amount of drag. In some embodiments, the frame thickness is in the range of about 0.01*D to about 0.30*D. In some embodiments, the frame thickness is in the range of about 0.02*D to about 0.20*D. In an example, the frame thickness is about 0.04*D. It should be recognized that other frame thicknesses within these ranges could be used depending on the circumstances of the use and the intended purpose.

The aft clearance is the distance that the flap is offset from the rear edge of the tail portion. The distance that the flap is offset from the rear edge of the tail portion can be selected from a wide variety of distances. On the low end, the distance could be about 0.00*D, because it provides a low turning radius. On the high end, the distance could be about 1.00*D, because a greater distance would provide too large a turning radius. The distance may be selected to provide a desired turning radius. In some embodiments, the aft clearance is in the range of about 0.05*D to about 1.00*D. In some embodiments, the aft clearance is in the range of about 0.10*D to about 0.50*D. In an example, the aft clearance is about 0.17*D. It should be recognized that other aft clearances within these ranges could be used depending on the circumstances of the use and the intended purpose.

The flap thickness 530 can be selected from a wide variety of thicknesses. For example, with a 30 millimeter projectile, on the low end the flap thickness could be about 0.01*D, because a thinner flap would not support sufficiently high aerodynamic loads. On the high end for a 30 millimeter projectile, the flap thickness could be about 0.30*D, because thicker flaps would be too large and/or too heavy for the projectile to support. The flap thickness may be selected to provide a sufficiently rigid aerodynamic surface. The flap has a flap thickness 530. In some embodiments, the flap thickness is in the range of 0.01*D to about 0.30*D. In some embodiments, the flap thickness is in the range of 0.03*D to about 0.20*D. In some embodiments, the flap thickness is in the range of 0.05*D to about 0.10*D. In an example, the flap thickness is about 0.07*D.

In some embodiments, the flap has an underside 531 that is a curved surface. In some embodiments, the flap has an underside that is a curved surface. It should be recognized that other flap thicknesses within these ranges could be used depending on the circumstances of the use and the intended purpose.

Any of the dimensions of the projectile may be selected to provide the best mission performance for the projectile. For example, the dimensions may be chosen to allow a projectile to travel at a desired velocity or to travel a desired distance.

Figure 8A:
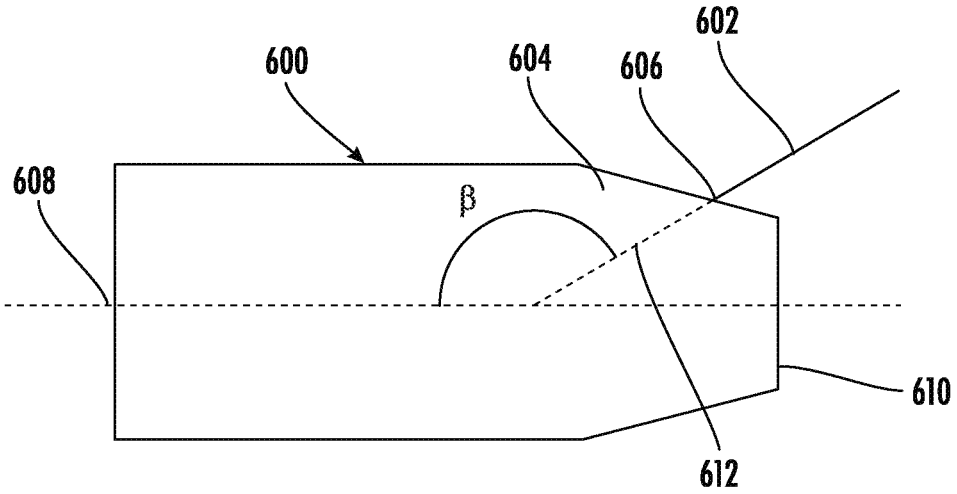
FIG. 8A illustrates a partial cross-sectional schematic view of a partial side view of an embodiment of a tail portion of a projectile according to the present disclosure with a flap hinged at a rear end of the flap.

FIG. 8A illustrates a partial cross-sectional schematic view of a partial side view of an embodiment of a tail portion of a projectile 600 according to the present disclosure with a deployable flap 602 secured to a body 604 of the tail portion by a hinge 606 at a rear end of the deployable flap 602. The deployable flap 602 pivots about the hinge 606 away from the longitudinal axis 608 of the body 604. When the deployable flap 602 is in the first position so the deployable flap 602 does not extend radially beyond the body 604 relative to the longitudinal axis 608, the hinge 606 is between the free end of the deployable flap 602 and a rear end 610 of the body 604. In FIG. 8A, the deployable flap 602 is rotated about the hinge 606 to a second position in which an axis 612 parallel to a control surface of the deployable flap 602 forms an obtuse angle β with the longitudinal axis 608 of the body 604.

The angle β may be selected based on aerodynamic modeling of a projectile and the desired aerodynamic performance of the projectile. The angle β can be selected from a wide variety of angles. On the low end, the angle could be about 140°, because a smaller angle generates too much drag and would slow the projectile too quickly to allow for effective maneuvering. On the high end, the angle could be about 175°, because a greater angle would provide an insufficient marginal increase in G-force to intercept a maneuvering target such as an unmanned aerial system (UAS) or an incoming missile. The flap angle may be selected to provide an optimal balance of increased G-force to enhance maneuvering while minimizing drag to allow for maximum effective range.

In some embodiments, the angle β is in the range of about 5° to about 60°. In some embodiments, the angle β is in the range of about 10° to about 50°. In some embodiments, the angle β is in the range of about 20° to about 40°. In one example, the angle β is about 33°. It should be recognized that other angles within these ranges could be used depending on the circumstances of the use and the intended purpose.

Figure 8B:
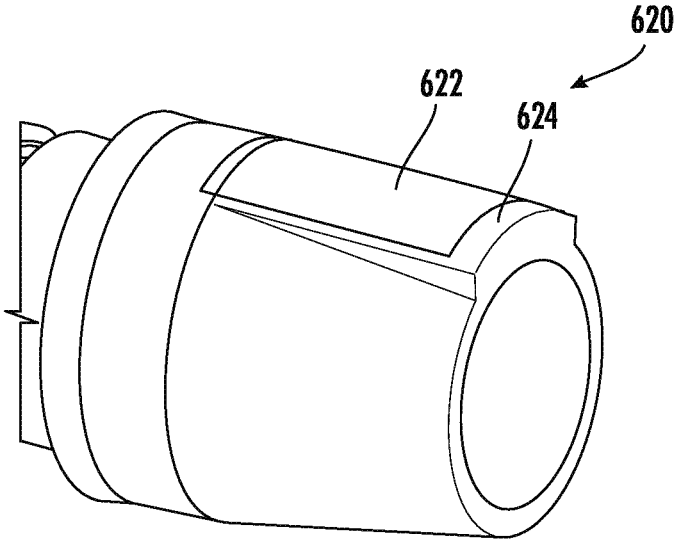
FIG. 8B illustrates a perspective view of an embodiment of a tail of a projectile with a flap in a first position.
Figure 8C:
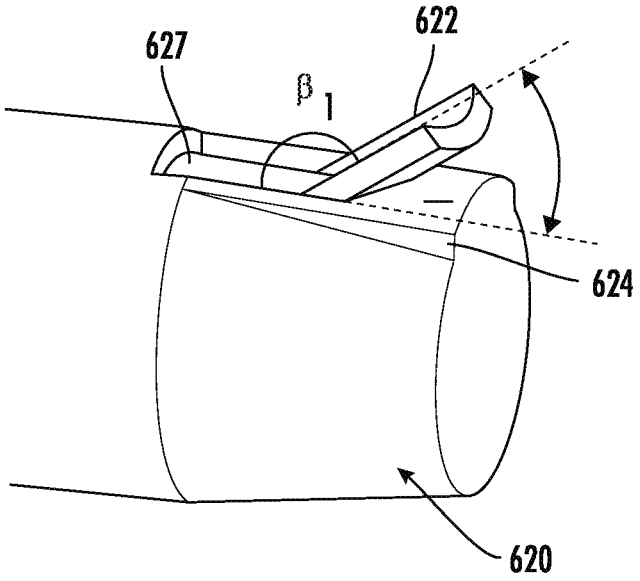
FIG. 8C illustrates a perspective view of the embodiment of FIG. 8B with the flap in a second position.

FIGS. 8B and 8C illustrate a tail portion 620 that includes a deployable flap 622 secured to the tail portion by a hinge 621. The deployable flap 622 is shown in the stowed position in FIG. 8B. The deployable flap is shown in the deployed position in FIG. 8C. A pyrotechnic charge located, for example, at point 627 in FIG. 8C may cause the deployable flap 622 to move from the stowed position to the deployed position.

In FIG. 8C, the deployable flap forms an angle $\beta_1$ with the surface 625 of the fixed flap.

In the stowed position, the deployable flap 622 is seated in a recess defined in a fixed flap 624. The fixed flap 624 extends beyond the deployable flap 622 in a circumferential direction by a frame thickness and extends beyond the deployable flap in a longitudinal direction by an aft clearance. The frame thickness and the aft clearance may be selected based on aerodynamic modeling and desired aerodynamic performance of the projectile.

The frame thickness can be selected from a wide variety of thicknesses. On the low end, the frame thickness could be about 0.01*D, because a smaller frame thickness results in a larger flap that provides too much drag. On the high end, the frame thickness could be about 0.30*D, because a larger frame thickness results in a smaller flap that provides insufficient drag. The frame thickness may be selected to provide a desired amount of drag. In some embodiments, the frame thickness is in the range of about 0.01*D to about 0.30*D. In some embodiments, the frame thickness is in the range of about 0.02*D to about 0.20*D. In an example, the frame thickness is about 0.04*D. It should be recognized that other frame thicknesses within these ranges could be used depending on the circumstances of the use and the intended purpose.

The aft clearance is the distance that the flap is offset from the rear edge of the tail portion. The distance that the flap is offset from the rear edge of the tail portion can be selected from a wide variety of distances. On the low end, the distance could be about 0.01*D, because it provides a low turning radius. On the high end, the distance could be about 0.50*D, because a greater distance would provide too large a turning radius. The distance may be selected to provide a desired turning radius. In some embodiments, the aft clearance is in the range of about 0.01*D to about 0.50*D. In some embodiments, the aft clearance is in the range of about 0.10*D to about 0.40*D. In an example, the aft clearance is about 0.25*D. It should be recognized that other aft clearances within these ranges could be used depending on the circumstances of the use and the intended purpose.

The flap has a flap thickness. The flap thickness can be selected from a wide variety of thicknesses. For example with a 30 millimeter projectile, on the low end the flap thickness could be about 0.01*D, because a thinner flap would not support sufficiently high aerodynamic loads. On the high end for a 30 millimeter projectile, the flap thickness could be about 0.30*D, because thicker flaps would be too large and/or too heavy for the projectile to support. The flap thickness may be selected to provide a sufficiently rigid aerodynamic surface. In some embodiments, the flap thickness is in the range of 0.01*D to about 0.30*D. In some embodiments, the flap thickness is in the range of 0.03*D to about 0.20*D. In some embodiments, the flap thickness is in the range of 0.05*D to about 0.10*D. In an example, the flap thickness is about 0.07*D. It should be recognized that other flap thicknesses within these ranges could be used depending on the circumstances of the use and the intended purpose.

Figure 9:
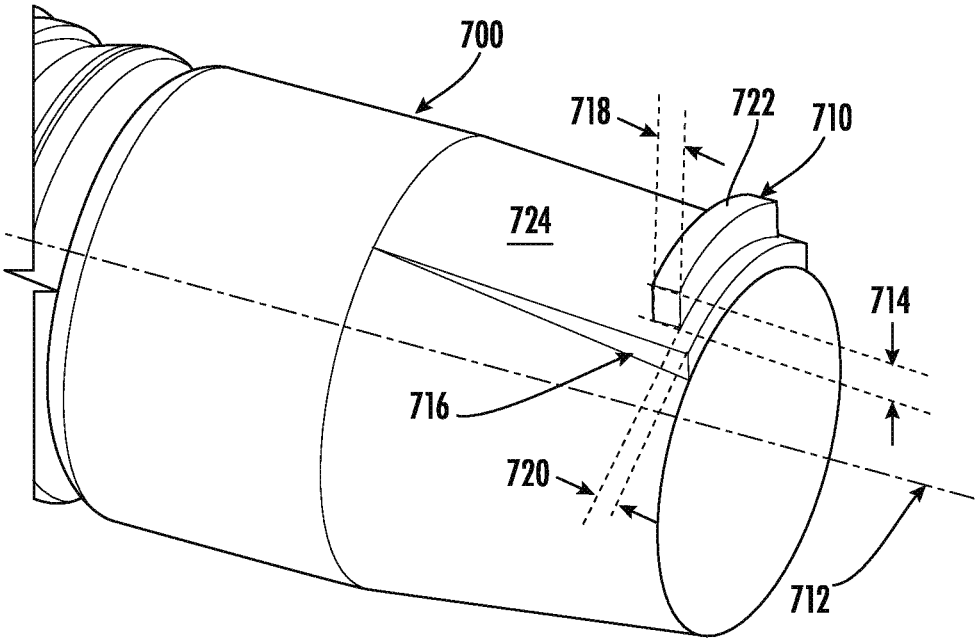
FIG. 9 illustrates a partial perspective view of an embodiment of a tail portion of a projectile according to the present disclosure with a deployable flap that is deployed by translating in an orthogonal direction with respect to the axis of rotation of the projectile.

FIG. 9 illustrates a perspective view of an embodiment of a tail portion 700 of a projectile according to the present disclosure with a deployable flap that is deployed by translating in an orthogonal direction with respect to the axis of rotation of the projectile.

In FIG. 9, the deployable flap 710 is oriented similarly to a gurney flap, so that a front surface of the deployable flap 710 extends in a direction that is orthogonal to the longitudinal axis 712 of the body of the projectile. The projectile spins about the longitudinal axis 712 of the body as the projectile exits a rifled barrel. When the projectile exits the rifled barrel, the deployable flap 710 is secured in a first position within a recess in the tail portion 700. The deployable flap 710 does not extend radially beyond an outer surface of the tail portion 700 when the deployable flap 710 is in the first position. When the deployable flap 710 moves to the second position, it translates with respect to the tail portion 700 so that the deployable flap 710 extends radially beyond the outer surface of the tail portion 700. The deployable flap 710 translates from the first position to the second position in a direction that is orthogonal with respect to the axis of rotation 712 of the body of the projectile.

In FIG. 9, the deployable flap 710 is in the second position. The angle between a front surface of the deployable flap and the longitudinal axis of the body may be selected based on aerodynamic modeling and desired aerodynamic performance of the projectile. In FIG. 9, a front surface of the deployable flap 710 forms an angle of 90° relative to the longitudinal axis 712 of the body of the projectile when the deployable flap is in the second position. The deployable flap 710 extends beyond the outer surface of the tail portion by a height 714. In particular, the deployable flap 710 extends beyond the outer surface of a fixed flap 716 on the tail portion 700. As noted above, the height can be in the range of about 0.01*D to about 0.40*D, where D is the nominal diameter of the projectile, such as 30 millimeters; the height may be in the range of about 0.05*D to about 0.15*D; the height may be in the range of about 0.08*D to about 0.12*D. In FIG. 9, the height 714 is 0.09*D. The height 714 is selected based on aerodynamic modeling and the desired aerodynamic performance of the projectile.

The deployable flap 710 can be secured relative to the tail portion 700 in intermediate positions. For example, the deployable flap can be secured relative to the tail portion 700 in intermediate positions in which the deployable flap 710 extends beyond the outer surface of the tail portion by a height 714 of 0.03 inch, 0.06 inch, and 0.10 inch, respectively.

As discussed above, the deployable flap may have a thickness in the longitudinal direction of the tail portion that is in the range of about 0.01*D to about 0.20*D, where D is the nominal diameter of the projectile, such as 30 millimeters; the thickness may be in the range of about 0.05*D to about 0.10*D; the thickness may be in the range of about 0.06*D to about 0.08*D. In FIG. 9, the deployable flap 710 has a thickness 718 of 0.07*D in the longitudinal direction of the tail portion 700.

As discussed above, the deployable flap may be offset from the rear edge of the tail portion by a distance in the range of about 0.00*D to about 2.00*D, where D is the nominal diameter of the projectile, such as 30 millimeters; the distance may be in the range of about 0.01*D to about 0.75*D from the rear edge of the tail portion; the distance may be in the range of about 0.02*D to about 0.25*D from the rear edge of the tail portion. In FIG. 7, the deployable flap 710 is offset by a distance 720 of 0.04*D from the rear edge of the tail portion 700.

The longitudinal position of the deployable flap may be selected based on aerodynamic modeling and the desired aerodynamic performance of the projectile. The base offset distance discussed above is applicable to deployable flaps that are placed near the rear edge of the projectile. In other embodiments, the deployable flap maybe be placed at another point along the length of a projectile.

As discussed above, the width of the deployable flap may be in the range of about 0.10*D to about 1.00*D when viewed from the rear end of the tail portion, where D is the nominal diameter of the projectile, such as 30 millimeters; the width may be in the range of about 0.30*D to about 0.60*D when viewed from the rear end of the tail portion; the width may be in the range of about 0.40*D to about 0.50*D when viewed from the rear end of the tail portion. In FIG. 9, the width of the deployable flap 710 is 0.44*D when viewed from the rear of the tail portion 700.

In FIG. 9, the deployable flap has an upper surface 722 that is tapered and curved to match the taper and curvature of the upper surface 724 of the fixed flap 716. In some embodiments, the upper surface of the deployable flap is planar, conical, cylindrical, or another shape.

In some embodiments, in the first position of the flap, the upper surface 722 of the deployable flap is flush with the upper surface 724 of the fixed flap. In some embodiments, in the first position of the flap, the upper surface 722 protrudes slightly above the upper surface 724 or is slightly recessed relative to the upper surface 724.

The dimensions of the deployable flap 710 and the fixed flap 716 were selected to achieve a desired change in direction for a projectile based on aerodynamic modeling.

According to another aspect of the present disclosure, a target acquisition and tracking system is provided. The target acquisition and tracking system may include a command unit that acquires and tracks a target and sends a signal to a projectile. The projectile may include a controller that is operable to deploy a deployable flap in response to the signal from the command unit.

In some embodiments, the target acquisition and tracking system includes at least one projectile, a command unit, and a weapon that facilitates launching the projectile(s).

In some embodiments, the target acquisition and tracking system includes a plurality of projectiles according to the present disclosure.

Figure 10:
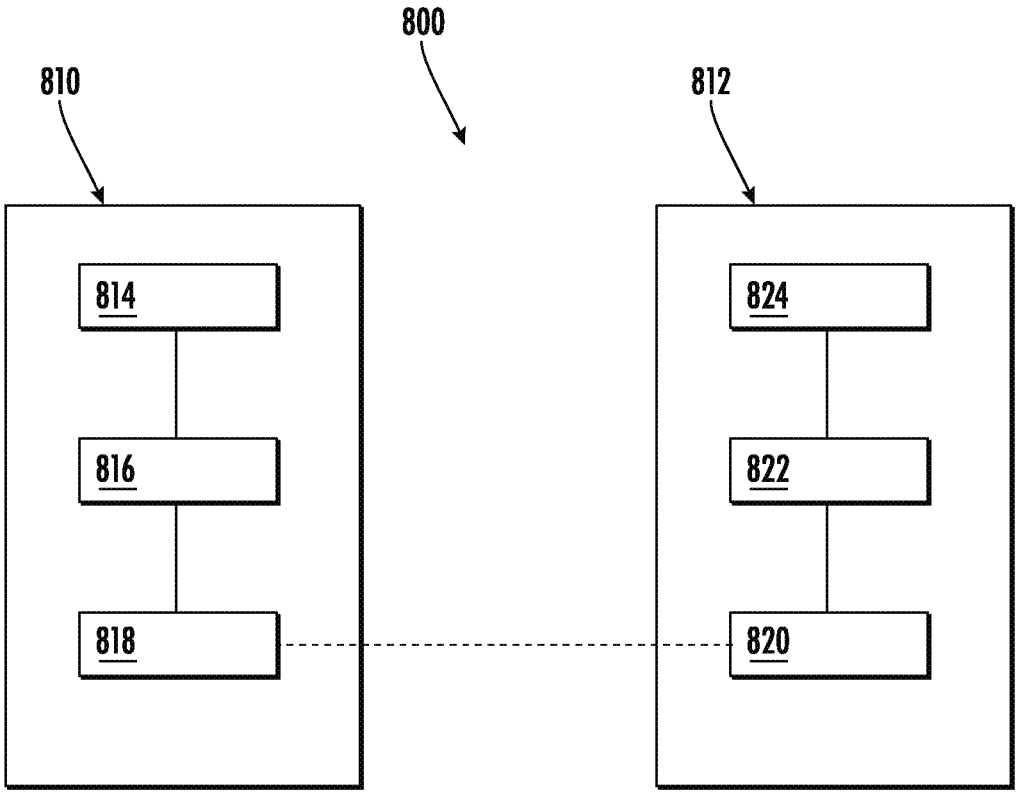
FIG. 10 illustrates a schematic of an embodiment of a system for target acquisition and tracking.

FIG. 10 shows a schematic of a target acquisition and tracking system 800. The system 800 includes a command unit 810. The command unit includes a sensor 814, a controller 816, and a transmitter 818. The command unit 810 is operable to provide maneuvering instructions to a projectile. The maneuvering instructions may be based on a sensed position of a target and a sensed position of the projectile that is to be maneuvered to the target.

The system 800 also includes a projectile 812. The projectile 812 includes a receiver 820, a controller 822, and a tail portion with a flap release mechanism 824. In some embodiments, the receiver 820, the controller 822, and the flap release mechanism 824 may be powered by an alternator that takes advantage of the relative spin of the front body and the tail. In some embodiments, the receiver 820, the controller 822, and the flap release mechanism 824 may be powered by a battery. The projectile 812 may be any projectile according to the present disclosure.

The receiver 820 of the projectile 812 is operable to receive instructions, such as maneuvering instructions, from the transmitter 818 of the command unit 810. The receiver 820 may be operable to receive a variety of signal types. In some embodiments, the receiver is operable to receive an electromagnetic signal. In some embodiments, the receiver is an RF receiver. In some embodiments, the receiver is operable to receive a signal that is outside of the visible light spectrum.

The controller 822 may include at least one processor. The controller 822 is operable, in response to instructions received by the transmitter, to cause a flap release mechanism 824 to release a movable flap of the projectile 812 from a first position in which the flap does not extend radially beyond the body of the projectile to a second position in which the flap extends radially beyond the body of the projectile and at an angle relative to the longitudinal axis. In the second position, the movable flap interacts with the airstream around the projectile to cause a lateral acceleration of the projectile.

The system 800 does not require a sensor on board the projectile 812 to track a target to which the projectile 812 is to be maneuvered. In some embodiments, the controller 822 is operable to cause the release mechanism 824 to deploy the movable flap of the projectile solely in response to the signal from the command unit.

EXAMPLE

Test Data

To determine the appropriate geometry of the deployable flap, computational fluid dynamics (CFD) modeling was performed. Parameters including angle of deployment, size of the flap, and location of the deployment hinge (i.e. hinged on the forward edge of the flap, or on the aft edge of the flap) were studied to assess their impact on the expected performance of the system. Based on these results, physical models of favorable geometries were fabricated and subject to wind tunnel testing to validate the CFD modeling. Results for the tested projectiles were compared to results for a typical fixed sub-caliber flap. A ratio of the acceleration achieved by each tested projectile to the acceleration achieved by a typical fixed sub-caliber flap was calculated.

Figure 11:
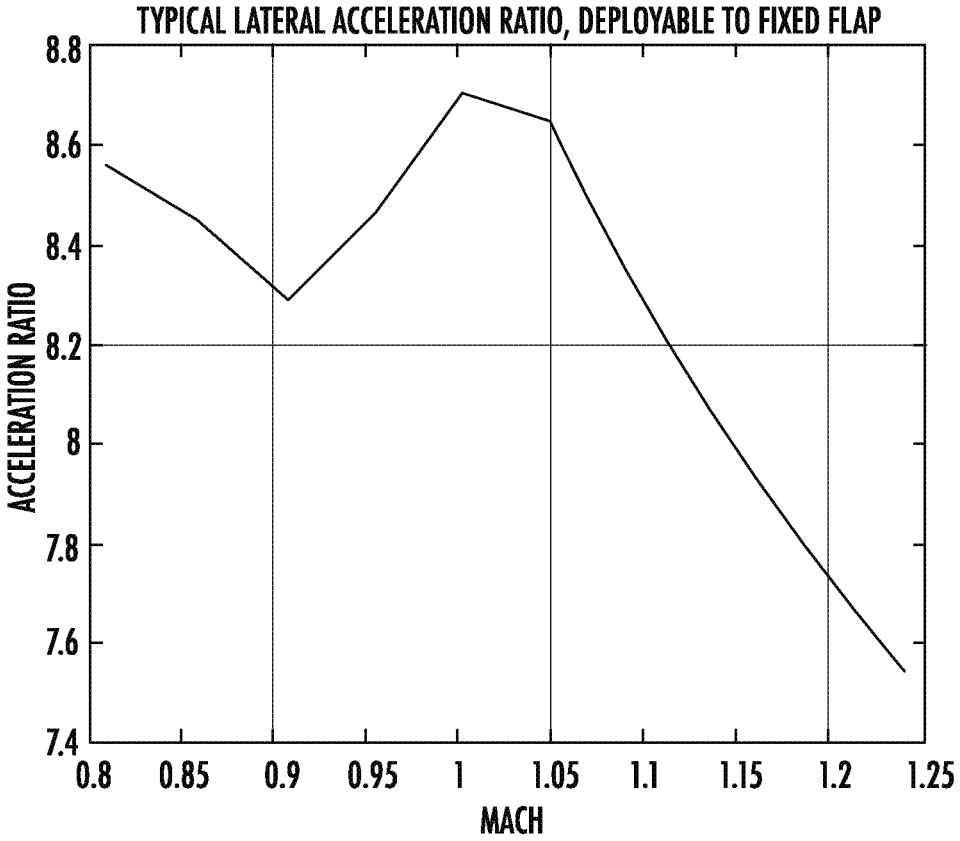
FIG. 11 illustrates ratios of acceleration of an embodiment of a projectile according to the present disclosure relative to a typical fixed sub-caliber flap versus velocity (in Mach number), based on wind tunnel testing.

FIG. 11 illustrates ratios of acceleration of an embodiment of a projectile according to the present disclosure relative to a typical fixed sub-caliber flap versus velocity (in Mach number), based on wind tunnel testing.

For the embodiment of the projectile of FIG. 11, when the projectile is traveling at Mach 1 and the deployable flap is deployed, the deployable flap achieves a lateral acceleration that is more than 8.6 times the magnitude of the lateral acceleration that is achieved by a projectile having a typical fixed sub-caliber flap. The embodiment of the projectile of FIG. 11 provides a useful increase in lateral acceleration of between 7 and 9 times the G-force provided by a fixed sub-caliber flap in the range of Mach 0.8 to Mach 1.25. In particular, this embodiment achieves an acceleration ratio of 7.4 or greater for Mach numbers in that same range.

This embodiment was chosen for use with a target because wind tunnel data show a favorable lateral acceleration ratio in the transonic region (Mach 0.8 to Mach 1.0). Simulation of the expected intercept profile with a representative target, such as an unmanned aerial system (UAS) or incoming missile, show that the velocity of the projectile at the time of intercept will be in the range of Mach 0.8 to Mach 1.0, and that at that point, the projectile is capable of achieving a G-force of between 7 and 9 times the magnitude of the lateral acceleration that is achieved by a projectile having a typical fixed sub-caliber flap.

Even when the projectile is traveling at greater than Mach 1.1, the deployable flap achieves a lateral acceleration that is more than 8.0 times the magnitude of the lateral acceleration that is achieved by a projectile having a typical fixed sub-caliber flap.

Having thus described several aspects of at least one embodiment, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A tail for a projectile, the tail comprising:
- a body having a longitudinal axis; and
- a steering assembly secured to the body, including:
  - a fixed flap having an inclined surface defined at a constant angle with respect to a surface of the body, the inclined surface extending from flush with the body at one end along the longitudinal axis of the body, and raised radially with respect to the body at another end, the fixed flap defining an opening within the inclined surface, and
  - a flap movable from a first position in which the flap does not extend radially beyond the inclined surface of the fixed flap and the flap is housed in the opening, to a second position in which the flap extends radially beyond the inclined surface of the fixed flap, and at an angle relative to the longitudinal axis; and
  - a flap release mechanism;
- wherein an aft clearance portion of the surface of the fixed flap is located rearward of the flap along the longitudinal axis, the aft clearance portion spanning at least the width of the rearward end of the fixed flap along the lateral axis.

2. The tail of claim 1, wherein the flap extends a predetermined distance in a radial direction beyond the inclined surface of the fixed flap when the flap is in the second position.

3. The tail of claim 2, wherein the flap extends at a predetermined angle with respect to the longitudinal axis when the flap is in the second position.

4. The tail of claim 1, wherein the flap release mechanism releases the flap from the first position to the second position in response to a predetermined event.

5. The tail of claim 4, wherein the predetermined event is a pyrotechnic event.

6. The tail of claim 5, wherein the pyrotechnic event is activation of a pyrotechnic charge.

7. The tail of claim 1, wherein the flap has a free end and a fixed end, the fixed end being connected to the body by a hinge.

8. The tail of claim 7, wherein the free end is rearward of the fixed end in a direction parallel to the longitudinal axis when the flap is in the first position.

9. The tail of claim 1, wherein the flap is secured to a fixed flap that is formed on the body.

10. The tail of claim 1, further comprising a plurality of strakes on the body.

11. A projectile, comprising:
- a front portion;
- a connection mechanism connected to the front portion; and
- a tail portion connected to the connection mechanism, the tail portion including
  - a body having a longitudinal axis; and
  - a steering assembly secured to the body, including:
    - a fixed flap having an inclined surface defined at a constant angle with respect to a surface of the body, the inclined surface extending from flush with the body at one end along the longitudinal axis of the body, and raised radially with respect to the body at another end, and the fixed flap defining an opening within the inclined surface;

a flap movable from a first position in which the flap does not extend radially beyond the inclined surface of the fixed flap and is housed in the opening, to a second position in which the flap extends radially beyond the inclined surface and at an angle relative to the longitudinal axis; and a flap release mechanism, wherein an aft clearance portion of the inclined surface of the fixed flap is located rearward of the flap along the longitudinal axis, the aft clearance portion spanning at least the width of the rearward end of the fixed flap.

12. The projectile of claim 11, wherein the flap extends a predetermined distance in a radial direction beyond the body when the flap is in the second position.

13. The projectile of claim 12, wherein the flap extends at a predetermined angle with respect to the longitudinal axis when the flap is in the second position.

14. The projectile of claim 11, wherein the flap release mechanism releases the flap from the first position to the second position in response to a predetermined event.

15. The projectile of claim 14, wherein the predetermined event is a pyrotechnic event.

16. The projectile of claim 15, wherein the pyrotechnic event is activation of a pyrotechnic charge.

17. The projectile of claim 11, wherein the flap has a free end and a fixed end, the fixed end being connected to the body by a hinge.

18. The projectile of claim 11, wherein the flap is stowed within the opening defined in the fixed flap, with other portions of the inclined surface of the fixed flap surrounding the flap in a circumferential direction to define boundaries of the opening as a frame thickness, and the aft clearance portion spanning the width of the frame thickness.

19. The projectile of claim 18, further comprising a plurality of strakes on the body.

20. A target acquisition and tracking system comprising:

a command unit including at least one sensor and a transmitter;

at least one projectile comprising a receiver that is operable to receive instructions from the transmitter of the command unit;

a tail, the tail comprising:

a body having a longitudinal axis; and a steering assembly secured to the body, including:

a fixed flap having an inclined surface defined at a constant angle with respect to the surface of the body, the inclined surface extending from flush with the body at one end along the longitudinal axis of the body, and raised radially with respect to the body at another end, the fixed flap defining an opening within the inclined surface;

a flap movable from a first position in which the flap does not extend radially beyond the inclined surface of the fixed flap and is housed in the opening, to a second position in which the flap extends radially beyond the inclined surface of the fixed flap and at an angle relative to the longitudinal axis, with an aft clearance portion of the inclined surface of the fixed flap located rearward of the flap along the longitudinal axis, other portions of the inclined surface of the fixed flap extending beyond the flap in a circumferential direction forming a frame thickness of the fixed flap, the aft clearance portion spanning the width of a frame thickness of the fixed flap; and a flap release mechanism; and a controller that is operable to cause the flap release mechanism to release the flap from the first position to the second position in response to instructions from the transmitter.

21. The system of claim 20, wherein the receiver is an RF receiver.

22. The system of claim 20, wherein the receiver is operable to receive an electromagnetic signal.

23. The system of claim 20, wherein the receiver is operable to receive a signal that is outside of the visible light spectrum.

24. The system of claim 20, wherein the controller deploys the flap solely in response to the signal from the command unit.

25. The system of claim 20, wherein the at least one projectile further comprises a plurality of strakes on the body.

* * * * *